United States Patent [19]

Chlad

[11] 4,323,329

[45] Apr. 6, 1982

[54] HYDRAULIC-DRIVEN ELECTRO-LIFTING DEVICE

[75] Inventor: Kenneth J. Chlad, Maple Heights, Ohio

[73] Assignee: Magnetics International, Inc., Maple Heights, Ohio

[21] Appl. No.: 13,056

[22] Filed: Feb. 21, 1979

[51] Int. Cl.[3] ..... B66C 1/06

[52] U.S. Cl. ..... 414/737; 294/65.5

[58] Field of Search ..... 294/65.5; 414/606, 618, 414/737, 744 C; 335/289, 291, 294

[56] References Cited

U.S. PATENT DOCUMENTS

| | | | |
|---|---|---|---|
| 2,622,750 | 12/1952 | Ehlers | 414/619 X |
| 3,009,727 | 11/1961 | Jones et al. | 294/65.5 |
| 3;016,260 | 1/1962 | Schrader | 294/88 |
| 3,045,620 | 7/1962 | Buck | 294/65.5 |
| 3,487,964 | 1/1970 | Riley | 294/65.5 X |
| 3,799,602 | 3/1974 | Laws et al. | 294/65.5 X |
| 4,005,895 | 2/1977 | Cullings | 294/65.5 |

*Primary Examiner*—Leslie J. Paperner

*Attorney, Agent, or Firm*—Wegner, Stellman, McCord, Wood & Dalton

[57] ABSTRACT

An improved mobile magnetic lifting assembly for providing magnetic pickup and release in response to hydraulic control. A hydraulic drive motor and electric generator are disposed within a housing which includes an electromagnet attached thereto. The motor drives the generator which is electrically coupled to an electromagnet. The housing includes a suspension brakcet for detachably securing the housing to the boom of a lifting apparatus, as a crane. Hydraulic connections extend through the housing to provide hydraulic motor drive control of the electrical power to the electromagnet.

9 Claims, 3 Drawing Figures

HYDRAULIC-DRIVEN ELECTRO-LIFTING DEVICE

BACKGROUND OF THE INVENTION

1. Field of the Invention

The present invention relates to magnetic lifting devices and, more particularly, to an improved hydraulically controlled magnetic lifting device for use with crane-type apparatus.

2. Description of the Prior Art

Various magnetic lifting devices have been proposed for use as attachments to different types of equipment; as, for example, cranes and the like. Such devices have generally been of the permanent magnet or electromagnet type and have been designed for lifting metallic objects, such as scrap metal and other objects of various weights and dimensions. The versatility of these devices for use in any particular situation with a variety of loads has been restricted by the need for specialized and complex control attachments to govern the lifting force and movement of the magnets.

By way of example, in devices employing permanent magnets, a variety of complex controls have been required to mechanically regulate the permanent magnet to enable the load and release. These controls are expensive, limited in their effectiveness, and usually require that the equipment undergo substantial modification prior to use.

In lifting equipment employing electromagnets, a primary source of electrical power is required to control magnetic attraction and release. Magnetic lifting devices of this type, therefore, may not be used without providing a separate or additional source of electrical power on the existing equipment.

SUMMARY OF THE INVENTION

Accordingly, a hydraulically-operated crane device is provided having a maneuverable boom and a magnetic lifting assembly that is readily adapted for use with hydraulically-operated equipment. The magnetic lifting assembly includes a hydraulic motor and electric generator enclosed within a housing which retains an electromagnet at one end thereof. The motor is coupled to drive the electric generator to the electromagnet for magnetic attraction and release. The housing is constructed as a unit with detachable couplings for hydraulic fluid lines leading to the motor, and a suspension bracket for removable attachment of the lifting assembly to the boom or control arm of a crane-type apparatus. As a unit, the magnetic lifting assembly may be readily attached to a variety of crane-type apparatus employing hydraulic control without substantial modification thereto. In addition, the hydraulic control of electrical power to the electromagnet simplifies control of magnetic attraction and release for various loads.

It is a feature of the present invention to provide a simplified and versatile magnetic lifting assembly.

Another feature of the invention is to provide a magnetic lifting assembly that may be readily attached and detached to a variety of crane-type apparatus.

Still another feature of the invention is to provide a magnetic lifting assembly that may be used interchangeably as an attachment to hydraulically controlled crane-type apparatus.

A further feature of the invention is to provide a magnetic lifting assembly which employs hydraulic motor control to regulate magnetic attraction and release.

Yet another feature of the invention is to provide a hydraulically-operated magnetic lifting device that is substantially retained within a single housing.

Other advantages and novel features will become apparent from the following detailed description when considered with the accompanying drawings.

DESCRIPTION OF THE PREFERRED EMBODIMENT

Figure 1:
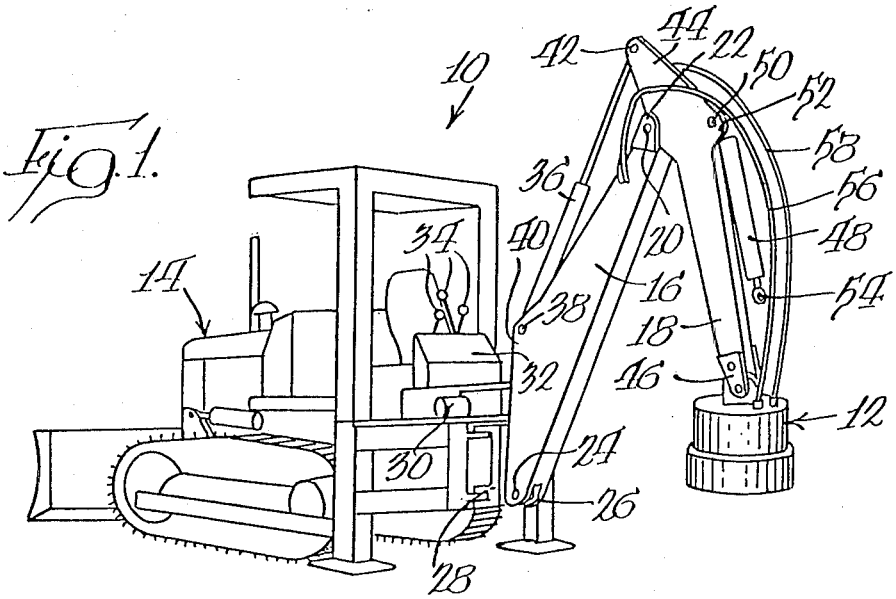
FIG. 1 is a diagram showing a typical crane-type apparatus incorporating the boom and magnetic lifting assembly in accordance with the teachings of the present invention.

Referring now to the drawings, wherein like numerals are used to identify like elements throughout, FIG. 1 depicts a conventional hydraulically-operated crane-type apparatus or device 10 employing a mobile magnetic lifting assembly 12. In the present example, the apparatus 10 includes a conventional bulldozer vehicle 14 acting as the carrier for a maneuverable boom formed by the pivoted arms 16 and 18, which carry the assembly 12. The hydraulically-controlled boom may be typically constructed in the same manner as is employed with a well known backhoe digger wherein the arm 18 is pivotally connected for vertical movement on a pin 20 carried by clevis 22 in one end of arm 16. The arm 16 is, in turn, pivotally connected for vertical movement on a pin 24 carried by clevis 26 through a portion of support member 28, which is coupled to vehicle 14 in such manner as to allow rotation of the support and boom about a vertical axis.

The boom is hydraulically controlled by hydraulic motor 30, which is actuated by levers 34 through hydraulic control unit 32 including valves (not shown), to control movement of the boom in a plurality of directions. Generally, one of the levers 34 is used to control the valve for the application of hydraulic fluid to control movement of the support 28 about a vertical axis. Another of the levers 34 is employed to control the valve for the application of hydraulic fluid for vertical movement of the arm 16. Still another of the levers 34 is employed to control the valve for the vertical movement of arm 18 by the application of hydraulic fluid to a dual hydraulic cylinder drive 36, which is secured at one end by a pin 38 carried by clevis 40 in the arm 16 and at the other end by a pin 42 carried by clevis 44 in the arm 18. Finally, in a conventional backhoe digger arrangement, yet another of the levers 34 is employed to control the valve for the movement of a digger bucket (attached to arm 18 by a pin carried by clevis 46) by the application of hydraulic fluid through lines 56 and 58 to a dual hydraulic cylinder drive 48 which is secured at one end by pin 50 carried by clevis 52 in the arm 18 and at the other end 54 by a pin and clevis connection in the conventional backhoe bucket (not shown).

Figure 2:
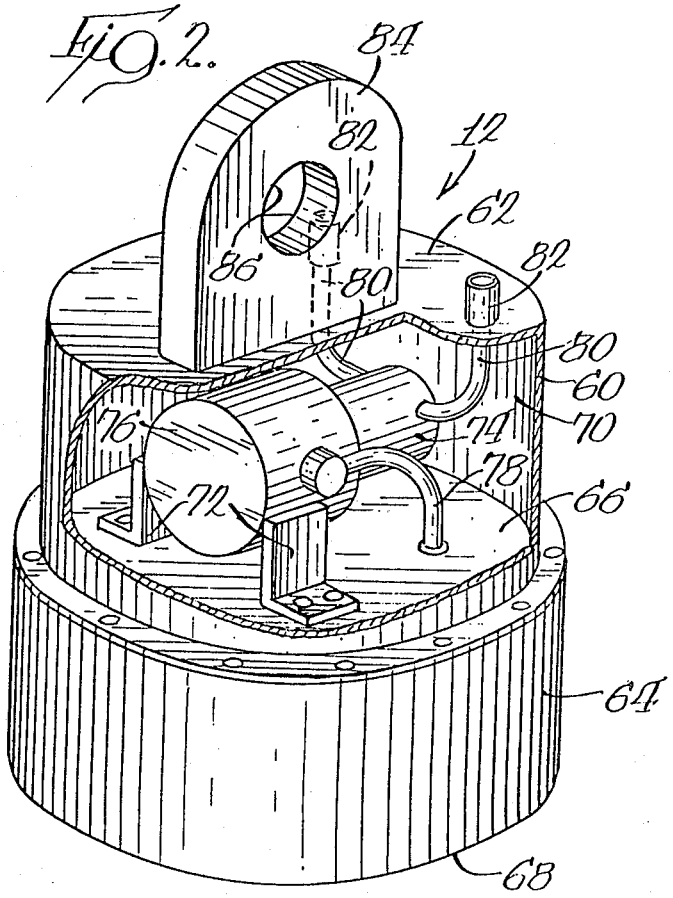
FIG. 2 is a perspective view of the magnetic lifting assembly employed in connection with the apparatus of FIG. 1.

In accordance with the present invention, however, the magnetic lifting assembly 12 is used as an alternative attachment in place of the backhoe bucket and is controlled by one of the levers 34 to provide magnetic attraction and release through hydraulic lines 56 and 58. Referring to FIG. 2, the magnetic assembly 12 includes a housing 60, which, in the present example, is generally found as a cylinder substantially closed at the upper end by end face 62. The housing 60 may be formed from any desirable material designed to be strong and durable under assembly operating conditions and is constructed to retain an electromagnet 64 at the lower end thereof. The electromagnet 64 is retained by the housing 60 so as to provide a top surface 66 spaced from the end face 62 within the housing 60, and an exposed magnetic surface 68, forming the contact area for the load to be lifted.

The spacing of the top surface 66 of the electromagnet 64 from the end face 62 forms an enclosed space 70 within the housing 60. Mounting brackets 72 are attached to the top surface 66 and coupled to mount a hydraulic motor 74 and D.C. generator 76 within the enclosed space 70. The hydraulic motor 74 may be provided with a flow control valve or a priority bypass valve to ensure proper hydraulic flow. The hydraulic motor 74 is mechanically coupled in any conventional fashion to drive the D.C. generator 76 in response to hydraulic fluid delivery through hydraulic line 80 coupled to the motor 74 by connector 82 in the end face 62 of housing 60. The D.C. generator 76 is, likewise, coupled to deliver electrical power to the electromagnet 64 through electrical cable 78 attached between the generator 76 and the electromagnet 64. The housing 60 also includes a suspension bracket 84, which may be welded or otherwise attached to a portion of the housing 60 and which includes a pivot hole 86 for removably attaching the magnetic assembly 12 to the boom in the apparatus of FIG. 1.

The operation of the assembly and boom arrangement will now be described with particular reference to the schematic lever control of FIG. 3. In the present instance, it is assumed that the mobile magnetic assembly may be considered as one of several alternative attachments to the crane-type apparatus 10 of FIG. 1. Accordingly, prior to use, a prior attachment may be disconnected by removing the pin carried by clevis 46 and the coupling to the end 54 of cylinder 48. Subsequently, the magnetic lifting assembly 12 is attached to the boom at arm 18 by the suspension bracket 84 using the same pin carried by clevis 46 to pivotally mount the housing through hole 86. At the same time, the hydraulic fluid lines 56 and 58 are disconnected from the cylinder 48 and attached to connectors 82 in the housing 60. The magnetic attraction and release may then be regulated by application of hydraulic fluid to the motor 74 under the control of one of the levers 34.

Figure 3:
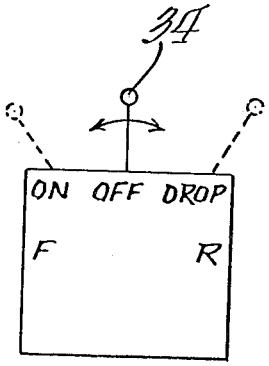
FIG. 3 is a schematic diagram generally illustrating the hydraulic control for regulating magnetic attraction and release of the assembly of FIG. 2.

Referring to FIG. 3, it is contemplated that the same lever as was used to control fluid delivery to cylinder 48 may be used to control fluid delivery to the motor 74. Accordingly, the lever control will generally be coupled to provide specific fluid control in these different positions. In the first position, illustrated as the "on" or "F" position, the lever will cause hydraulic fluid flow in a forward direction through lines 56 and 58 to the motor 74. The motor will, in turn, drive the D.C. generator 76 to cause the delivery of electrical power to the magnet 64 through cable 78. Upon application of electrical power, the magnet will become attractive to the desired load with a force controlled by the speed of the motor-generator as determined by lever control of fluid flow rate. The boom, therefore, may be hydraulically controlled in a conventional manner to position the magnetic assembly over a desired load, and, thereafter, the lever moved to the first "F" position to magnetically attract the load.

Following magnetic attraction, the boom may be hydraulically manipulated to move the load to a desired position. During this time, the magnetic attraction may be maintained by continued fluid flow in the forward direction with the lever in the "F" position. Alternatively, however, the lever may be moved to a second or "off" position in which the flow of hydraulic fluid is stopped while still retaining magnetic attraction. In the second lever position, the rotation of hydraulic motor and generator is stopped thereby stopping the application of D.C. power to electromagnet. At this time, however, the magnet, due to its large inductance, will discharge back into the generator to dissipate accumulated internal energy. Nevertheless, the magnet may still retain the load (depending upon magnet size and load weight) so long as residual magnetism is present. Thus, the load may be moved from its position using the effect of residual magnetism.

Upon completion of load movement, the load may be detached by movement of the lever to a third "drop" or "R" position. In this position, the hydraulic fluid is controlled to flow in a direction opposite to the direction of fluid flow when the lever was in the first position. Consequently, the motor and generator rotation is reversed and a voltage of opposite polarity to that received during the lift period is applied to the electromagnet. The change in polarity causes the magnet to repell the load thereby enabling release. In this instance, the lever need only be held in the third position to cause fluid flow reversal for a time of about 1–2 seconds. Thereafter, the lever may be returned to the "off" position prior to initiation of the same steps for lifting of additional loads.

As can be seen from the above description, the present invention provides a hydraulically-operated crane device which employs a maneuverable boom and magnetic lifting assembly. The assembly is contained within a single housing which provides protection for use in harsh environments and facilitates removable attachment to crane devices. The assembly is constructed to enable ready attachment without substantial modification of existing hydraulic fluid control lever in those instances in which the assembly is used as an alternative attachment to hydraulic crane devices. In addition, the hydraulic control of this application of electrical energy to the electromagnet enables magnetic attraction and load release from any boom position thereby simplifying control of the assembly under any load conditions.

While the present invention has been described with particular reference to the specific crane-type apparatus of FIG. 1, the teachings are equally applicable to use of the magnetic lifting assembly with a variety of other apparatus. Thus, the assembly may be otherwise constructed to allow separate hydraulic movement of the magnetic assembly in a manner similar to the backhoe bucket and other crane-type attachments. In addition, the attachment of the assembly to the boom may be modified to have separate hydraulic control to enable attachments to different boom arrangements. Further, while the housing was described as having a cylindrical configuration, other configurations of housing and magnet could be employed without departing from the present teachings.

Therefore, many other modifications and variations are possible in light of the above teachings. It is, therefore, to be understood that within the scope of the appended claims the invention may be practiced otherwise than as specifically described.

I claim:

1. A mobile magnetic lifting assembly comprising:
a housing;
an electromagnet retained in said housing and having an exposed magnetic surface for contacting a load to be lifted.
an electric generator disposed within the housing and coupled to provide electrical power to said magnet;
a hydraulic drive motor disposed within said housing and coupled to drive the electric generator;
means coupled through said housing for supplying hydraulic fluid to said hydraulic drive motor; and
suspension means on said housing for enabling removable attachment to a lifting device.

2. The assembly of claim 1 wherein said housing is substantially cylindrical and closed by an end face at one end thereof and wherein said housing retains an electromagnet at an opposite end spaced from the end face of said housing to provide an enclosed space, said generator, said hydraulic drive motor, and a portion of said means for supplying hydraulic fluid being disposed within said enclosed space.

3. The assembly of claim 2 wherein said electromagnet includes a top surface extending across said housing and mounting bracket means attached to said surface for supporting said electric generator and said hydraulic drive motor.

4. The assembly of claim 2 wherein said suspension means comprises a suspension bracket attached to the end face of the housing.

5. A hydraulically-operated crane device, comprising:
a maneuverable boom fulcrumed at one end for maneuvering in a selected one of a plurality of directions;
a magnetic lifting assembly attached at the other end of said boom;
hydraulic means coupled to said boom and to said magnetic assembly for controlling movement of said boom in a desired direction;
said magnetic lifting assembly including:
a housing;
an electromagnet retained in said housing and having an exposed magnetic surface for contacting a load to be lifted;
an electric generator disposed within the housing and coupled to provide electrical power to said magnet;
a hydraulic drive motor disposed within said housing and coupled to drive the electric generator;
means coupled through said housing for supplying hydraulic fluid from said hydraulic means to said hydraulic drive motor; and
suspension means of said housing for removably attaching said assembly to the boom, said hydraulic means including control means for controlling fluid flow to drive said motor.

6. The device of claim 5 wherein said housing is substantially cylindrical and closed by an end face at one end thereof and wherein said housing retains said electromagnet at an opposite end spaced from the end face of said housing to provide an enclosed space in which said generator, said hydraulic drive motor, and a portion of said means for supplying hydraulic fluid are disposed.

7. The device of claim 6 wherein said electromagnet includes a top surface extending across said housing and mounting bracket means attached to said surface for supporting said electric generator and said hydraulic drive motor.

8. The device of claim 6 wherein said suspension means comprises a suspension bracket attached to the end face of the housing.

9. A hydraulically-operated crane device, comprising:
a maneuverable boom fulcrumed at one end for maneuvering in a selected one of a plurality of directions;
a magnetic lifting assembly attached at the other end of said boom;
hydraulic means coupled to said boom and to said magnetic assembly for controlling movement of said boom in a desired direction;
said magnetic lifting assembly including:
a housing;
an electromagnet retained in said housing and having an exposed magnetic surface for contacting a load to be lifted;
an electric generator disposed within the housing and coupled to provide electrical power to said magnet;
a hydraulic drive motor disposed within said housing and coupled to drive the electric generator;
means coupled through said housing for supplying hydraulic fluid from said hydraulic means to said hydraulic drive motor;
suspension means on said housing for removably attaching said assembly to the boom, said hydraulic means including control means for controlling fluid flow to drive said motor, said control means being a valve constructed to provide magnetic control by movement to a plurality of positions including a first portion for providing hydraulic fluid flow to drive said motor in a first direction, a second position for stopping hydraulic fluid flow and motor drive, and a third position for providing hydraulic fluid flow to drive said motor in a second direction opposite to said first direction.

* * * * *